US006579081B1

(12) United States Patent
Kuznetsov

(10) Patent No.: US 6,579,081 B1
(45) Date of Patent: Jun. 17, 2003

(54) SPHERICAL POSITIVE-DISPLACEMENT ROTARY MACHINE

(75) Inventor: Mikhail Ivanovich Kuznetsov, Moscow (RU)

(73) Assignee: Finpar Holding S.A., Luxembourg (LU)

( * ) Notice: Subject to any disclaimer, the term of this patent is extended or adjusted under 35 U.S.C. 154(b) by 0 days.

(21) Appl. No.: 09/937,267

(22) PCT Filed: Mar. 1, 2000

(86) PCT No.: PCT/RU00/00070

§ 371 (c)(1),
(2), (4) Date: Jan. 14, 2002

(87) PCT Pub. No.: WO00/57028

PCT Pub. Date: Sep. 28, 2000

(30) Foreign Application Priority Data

| | | |
|---|---|---|
| Mar. 22, 1999 | (RU) | 99106138 |
| May 24, 1999 | (RU) | 99111234 |
| May 24, 1999 | (RU) | 99111235 |
| May 24, 1999 | (RU) | 99111237 |

(51) Int. Cl.[7] ..... F01C 3/06
(52) U.S. Cl. ..... 418/68; 418/94; 418/104
(58) Field of Search ..... 418/22, 68, 94, 418/104

(56) References Cited

U.S. PATENT DOCUMENTS

| | | | | | |
|---|---|---|---|---|---|
| 221,599 | A | * | 11/1879 | Murray, Jr. | 418/68 |
| 389,927 | A | * | 9/1888 | Hurdle et al. | 418/68 |
| 1,678,049 | A | * | 7/1928 | Kearney | 418/68 |
| 2,204,760 | A | * | 6/1940 | Jensen | 418/68 |
| 2,727,465 | A | * | 12/1955 | Dutrey | 418/68 |
| 3,816,039 | A | | 6/1974 | Berry | 418/68 |
| 4,877,379 | A | | 10/1989 | Okabe | 418/51 |
| 5,171,142 | A | * | 12/1992 | Proglyada | 418/68 |

FOREIGN PATENT DOCUMENTS

| | | | |
|---|---|---|---|
| DE | 954027 | * 12/1956 | 418/68 |
| GB | 1192615 | 5/1970 | |
| RU | 2012823 | 5/1994 | |
| SU | 877129 | 11/1981 | |

* cited by examiner

*Primary Examiner*—John J. Vrablik
(74) *Attorney, Agent, or Firm*—Jordan and Hamburg LLP

(57) ABSTRACT

The proposed positive-displacement sphere-shaped rotor machine is intended for use as an engine, a pump or a compressor and comprises a casing consisting of two parts 1 and 2, in the spherical cavity of the casing three rotors 4, 5 and 6 being disposed, the central disk rotor 4 being connected from each side by means of a diametrical hinge with sector rotors 5 and 6. The rotors 4, 5 and 6 define four chambers 9, 10, 11 and 12. The chamber-forming radial surfaces of the rotors 4, 5 and 6 have a radius form. Inlet-outlet ducts 15, 16, 17 and 18 are disposed in the zone of overlapping by the sector rotors at the moment of changeover of the cycles in the chambers, the ducts having a nozzle portion and a tangential tilt. The diametrical hinge has two secured semi-axles 21 and 22, whose journals enter into spherical meniscus 25; the second diametrical hinge 5 has a non-split cylindrical axle. The half-casings 1 and 2 are provided with centering device 3 which makes it possible to vary the phase-setting angle and the precession of the machine. Cooling and lubrication of the rotor unit is effected through a network of ducts 26, 27, 28, 29 and 30 disposed therein. Between the parts 1 and 2 of the casing a gap is provided, which ensures the assembleability of the machine.

7 Claims, 4 Drawing Sheets

SPHERICAL POSITIVE-DISPLACEMENT ROTARY MACHINE

FIELD OF THE ART

The present invention relates to mechanical engineering, and more particularly to positive-displacement-action machines, and may be used as an engine, a pump, a compressor or a metering device.

PRIOR ART

Known in the art is a positive-displacement sphere-shaped rotor machine comprising a casing consisting of two interconnected parts, in a spherical cavity of the casing three rotors are disposed that define four chambers. A central rotor is connected from each side by means of a diametrical hinge to a sector rotor in the form of a ball sector, made integral with a shaft. The axes of rotation of the sector rotors are disposed at a certain angle to each other and intersect the axes of the diametrical hinges in the center of the spherical cavity. The axes of the diametrical hinges are perpendicular to each other. The rotors adjoin with their peripheral surfaces the spherical cavity of the machine casing in which four inlet-outlet ducts are disposed (JP No. 47-44565, PCT/SU89/00133).

The known machine is disadvantageous in that the thickness of the sector rotor in the shaft region is small. As a result, the shaft diameter and the size of main bearings are limited, the zone of total overlapping of the spherical cavity of the casing by the spherical surface of the rotor is insufficiently developed, and, as a consequence, the packing devices bordering the hot zone of the working chambers are complicated and ineffective. Locating the inlet-outlet ducts near the bearing units mutually limits their effectiveness. A relatively small thickness of the shafts and sector rotors makes the heat removal therefrom difficult, and this brings about their considerable calorific intensity. The presence of a large dynamically unbalanced mass on the periphery of the central rotor leads to the origination of considerable internal stresses and deformations at high rotation speeds of the rotors. The above-said disadvantages limit the performance and reliability of the machine.

A machine is known, wherein the semi-axles of diametrical hinges are removable and provided with grooves, and sector rotors are provided with projections mating the latter, the central rotor has a bore, and the sealing is made removable and is disposed in the bore (SU No. 877129).

This machine is disadvantageous in that the semi-axles of the diametrical hinges are disposed freely, whereby the speed of rotation of the rotors is limited because of high centrifugal loads of the freely disposed semi-axles acting on the sphere-forming surface of the machine.

DISCLOSURE OF THE INVENTION

It is an object of the present invention to increase the performance and prolong the service life of the positive-displacement sphere-shaped rotor machine.

This object is accomplished by the provision of a positive-displacement sphere-shaped rotor machine comprising a casing consisting of two interconnected parts, in a spherical cavity of the casing three rotors being disposed that define four working chambers, a central rotor connected from each side by means of a diametrical hinge to a sector rotor in the form of a ball sector, made integral with a shaft, the axes of rotation of the sector rotors being disposed at a certain angle to each other and intersecting the axes of the diametrical hinges in the center of the spherical cavity, the axes of the diametrical hinges being perpendicular to each other, the rotors adjoining with their peripheral surfaces the spherical cavity of the machine casing in which four inlet-outlet ducts are disposed, in which machine, according to the invention, chamber-forming radial surfaces of the sector rotors are formed by two and more planes or by a curvilinear or plano-curvilinear surface which provides an increase of the sector-forming angle from the diametrical hinge to the peripheral spherical surface, measured between the axis of rotation of the sector rotor and a straight line connecting the center of the sphere with a point on the chamber-forming surface of the sector rotor, and the chamber-forming surface of the central rotor repeats the form of the sector rotor surface corresponding thereto.

The above-described structural embodiment makes it possible to increase substantially the performance and service life of the machine.

The invention will be better understood from the following description of particular embodiments thereof with reference to the accompanying drawings.

BRIEF DESCRIPTION OF THE DRAWINGS

FIG. 4 shows a diagram of the machine coordinates similar to geographic ones, wherein:

Figures 1, 1A:
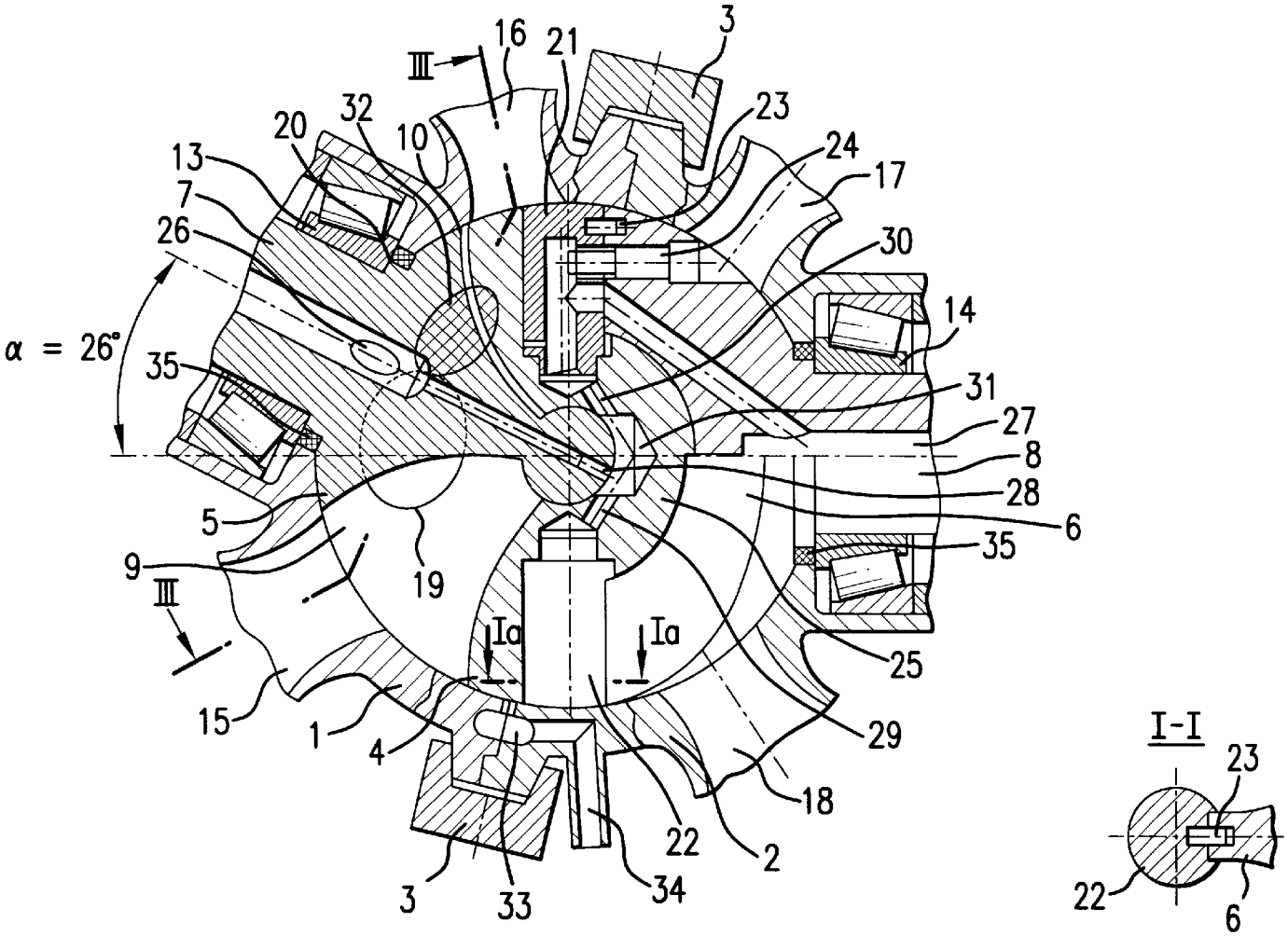
FIG. 1 shows a positive-displacement sphere-shaped rotor machine in longitudinal section.
FIG. 1*a* is a cross section view of a portion of a sector rotor taken along line I*a*—I*a* of FIG. 1.

points A, B—machine poles—are formed by the intersection of the axes of rotation of sector rotors with the chamber-forming spherical surface of the cavity;

angle $\alpha$ is referred to as the angle of precession of the machine (from the late Latin 'praecessio'—going before);

arc ACB—the zero meridian of the coordinate system—is the line on the spherical surface, which shortcuts the machine poles. The positive direction of coordinate reading is assumed to be the direction of rotation of rotation of the machine rotors during the main working cycle, the angle $\lambda$;

angle $\psi$—coordinate latitude—is measured from the axis of rotation of the sector rotors;

equator—is the line on the spherical surface, equidistant from the poles in each meridian section, the circumference with points PC;

line AMPB—is the meridian section of the sphere, AC=CB, AP=PB, wherein point M has the following coordinates:

latitude—the angle $\psi$, longitude—the angle $\lambda$.

The proposed coordinate system is in fair agreement with the kinematics of the machine and convenient technological bases.

BEST MODE OF CARRYING OUT THE INVENTION

The herein-proposed positive-displacement sphere-shaped rotor machine (hereafter referred to as the machine)

comprises a casing consisting of two parts 1 and 2 interconnected by a yoke 3, with three rotors disposed in the spherical cavity of the casing. The central rotor 4 is connected from each side by means of a diametrical hinge to sector rotors 5 and 6. The sector rotors consist of a ball sector made integral with shafts 7 and 8 which are mounted in half-casings in bearing units with main bearings 13 and 14. The rotors form four chambers 9 and 10 (FIG. 1) adjacent to the sector rotor 5 and chambers 11 and 12 (FIG. 2) adjacent to the sector rotor 6. The precession of the machine is 26°. The chamber-forming radial surfaces of the sector rotors have a cylindrical shape with a radius equal to the radius of the chamber-forming sphere. In the general case the surfaces may be formed by two and more planes or by a curvilinear or plano-curvilinear surface. The chamber-forming radial surface provides an increase of the sector-forming angle of the ball sector from the area of the diametrical hinge to the peripheral spherical surface. The sector-forming angle is measured between the axis of rotation of the sector rotor and a straight line connecting the center of the sphere with a point on the chamber-forming surface of the sector rotor, this corresponding to a progressing increase in the thickness of the sector rotor from the center to the pole portion. The chamber-forming surface of the central rotor repeats the form of the sector rotor surface corresponding thereto. Thus, in the herein-cited machine the sector-forming angle in the area of the diametrical hinge is 25° and increases toward the periphery up to 36°, whereby the diameter of the zone in which the polar portion is completely overlapped increases to 0.63 D, where D denotes the diameter of the chamber-forming sphere of the machine.

The proposed shape of the chamber-forming surfaces of the machine rotors makes it possible:

- to increase the diameter of complete overlapping of the pole portion of the spherical cavity of the casing by the surface of the sector rotors, which allows one to increase the diameter of the shaft and the size of the main bearings, to improve the obturation of the working chambers, to space the hot surfaces of the working chambers farther apart from the bearing units and to decrease the thermal factor of the sector rotors;
- to provide maximum possible encompassing of the sector rotor axles by the mating part of the diametrical hinge of the central rotor in the area of the diametrical hinge;
- to diminish the peripheral portion of the central rotor and thereby to reduce the dynamic and thermal deformations of the central rotor and to increase the speed of rotation thereof.

The above-cited features reduce the dynamic and thermal intensity of the machine and make it possible to improve its performance and prolong its service life.

Figure 2:
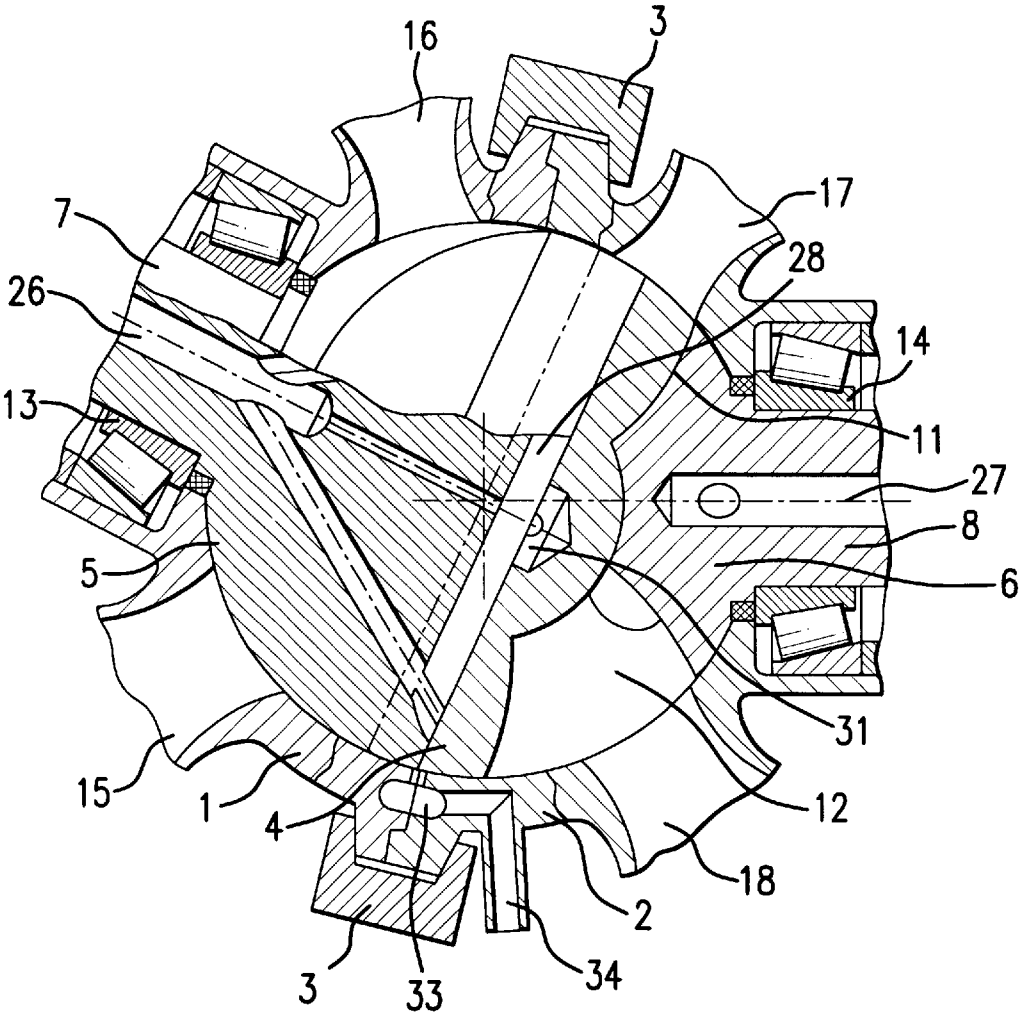
FIG. 2 shows a machine with rotors turned through 90 degrees.
Figure 3:
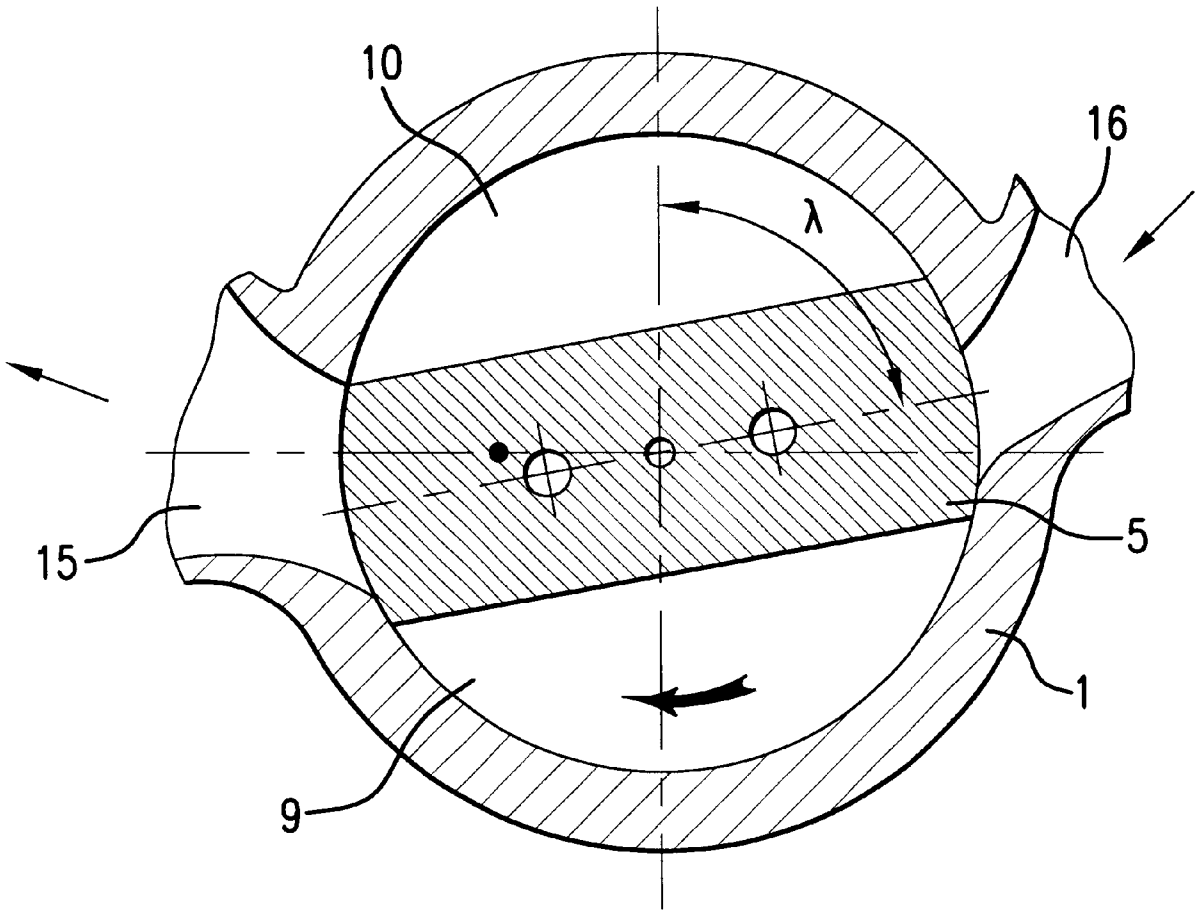
FIG. 3 shows a section taken along line III—III at the axes of inlet—outlet ducts at the moment of cycle changeover in working chambers.
Figure 4:
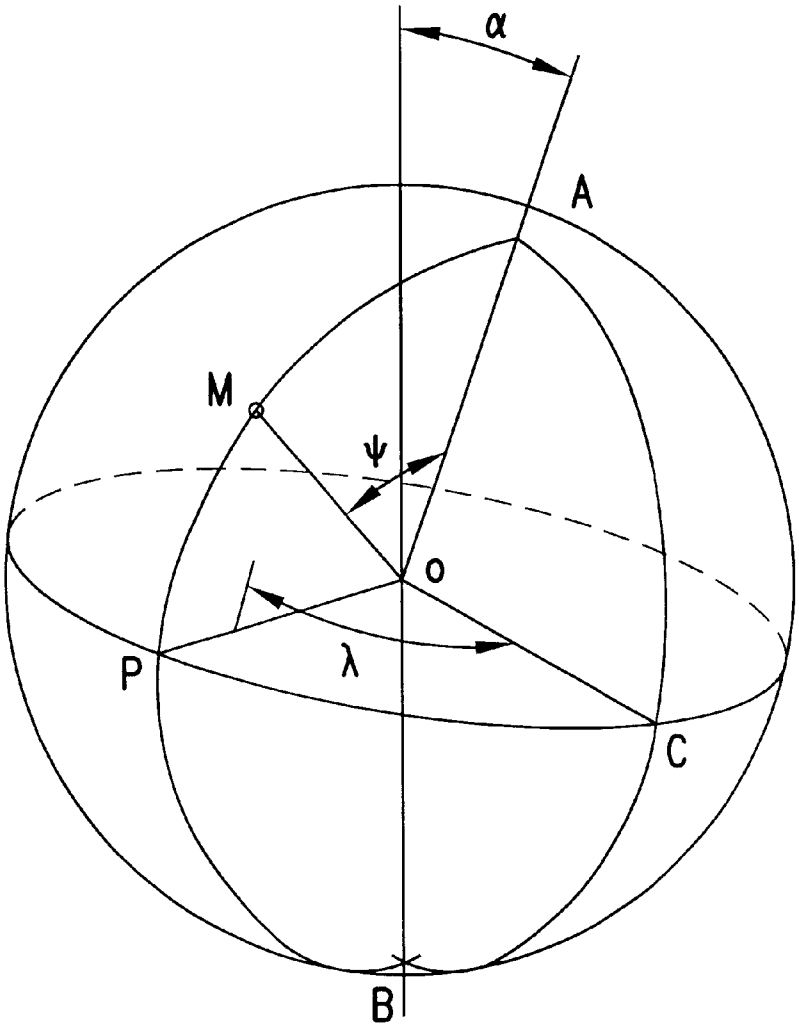

Inlet-outlet ducts 15, 16, 17, 18 are arranged in pairs and disposed in a diametrically opposite manner in each half-casing in the zone of overlapping by the spherical surface of the sector rotor as it turns through an angle of up to 90° in the direction of rotation, measured with respect to the axis of the diametrical hinge of the sector rotor and to the zero meridian. In FIGS. 1 and 2 the section of the ducts is shown in the plane of the machine section, passing through the zero meridian. The latitude of the duct edge portion nearest to the pole is equal to or greater than the latitude of the circumference of the complete overlapping of the pole portion of the spherical cavity of the casing by the spherical surface of the sector rotor. By displacing the ducts into the equatorial area it becomes possible to move them away from the bearing units, while an increase in the thickness of the spherical portion of the ball sector of the sector rotor which overlaps the ducts permits an increase in the flow area of the ducts. In FIG. 1 the actual position of the duct 15 is shown at 19, wherein the continuous line indicates the visible portion of the edge and the dotted line indicates the edge portion shut out by the sector rotor. The hatched area 20 corresponds to the position of the duct 16. Shown in FIG. 3 is a section II—II taken along the axes of the inlet-outlet duct 15 and 16 at the moment of the cycle changeover in the working chambers, corresponding to the turn of the sector rotor through an angle 80°, which is a phase-setting angle and depends on the dynamics of the machine and the characteristics of the working medium. The inlet-outlet ducts may have a nozzle portion with a variable exit section. The axes of the ducts may have a tangential tilt, the tilt of the inlet duct 16 being predominantly coincident with, and the tilt of the outlet duct 15 being predominantly opposite to; the direction of rotation of the machine rotors. Arrows indicate the direction of flow of the working medium in the inlet duct 16, its flow in the working chamber, coincident with the direction of rotation of the rotors and its outflow into the outlet duct 15, effected when the machine operates as a steam engine. The chamber 9 is a working chamber and is found at the end of the working cycle. The chamber 10 is cocked (the volume of the chamber is minimum, the working medium is expelled) and is ready to receive a charge of the working medium. For reversible, low-speed machines (e.g., for hydraulic pumps, hydraulic motors, etc.) the phase-setting angle may be equal to 90° and the tangential tilt of the ducts may be absent.

The displacement of the inlet-outlet ducts toward the equatorial area, the provision of nozzle portions and of tangential tilts of the ducts reduce the hydrodynamic of the supply lines, facilitate circulation of the working medium in the machine, improve the operation conditions of the bearing units, whereby the performance and service life of the machine as a whole become enhanced.

The diametrical hinge of the sector rotor 6 has two semi-axles 21 and 22 which are mounted on flanges of the sector rotor and secured thereon into its body with the help of fixing devices, a pin 23 and a bolt 24, which rule out the possibility of the semi-axle displacement relative to the sector rotor. From the side facing the center of the sphere, each semi-axle is provided with a journal. The journals are located in openings made in a spherical meniscus projection 25. The meniscus is coaxial with the chamber-forming sphere and is an extension of the central rotor 4 (here and hereafter in the text the term "meniscus" is used to denote the spherical projection disposed on the central rotor, and the hinge will be termed "meniscus hinge", respectively). The sector rotor has a spherical cavity which is congruent with the shape of the meniscus and forms projections on which the semi-axles of the meniscus hinge are mounted. The journals of the semi-axles of the meniscus hinge may have a complicated, stepped shape, the openings in the meniscus mating said shape. The second diametrical hinge of the sector rotor 5 has one non-split cylindrical axle. In this case there is no meniscus in the hinge, the axle may be made separately from the hinge and be fastened thereto in a manner similar to the case with the semi-axles of the meniscus hinge. There being no meniscus in the hinge, the volume of the adjacent chambers of the sector rotor 5 is larger than the volume of the adjacent chambers of the rotor 6.

An embodiment of the machine is possible, in which both diametrical hinges have a meniscus structure; in such a case the volume of the chambers may be equal.

The use of fixing devices for fixing and fastening the axles of the diametrical hinges makes it possible to increase the speed of rotation of the rotors, while providing for the assembleability of the rotor unit. The journals of the semi-axles increase the carrying capacity and rigidity of the meniscus hinge. The above-cited features of the diametrical hinges of the rotor unit make it possible to improve the performance and prolong the service life of the machine.

The proposed machine has a centering device which makes it possible to vary the value of the phase-setting angle. The half-casings 1 and 2 are interconnected in the equatorial plane, equidistant from the machine poles in each meridian section. In one of the half-casings 1 an annular groove is provided, adapted to receive an annular projection of the second half-casing 2, thus constituting a centering device. The half-casings are interconnected by means of the yoke 3 which permits their angular displacement with respect to each other and to the zero meridian.

The mutual angular displacement of the half-casings 1 and 2 makes it possible to vary the value of the phase-setting angle, whereby the working cycle of the machine can be varied within a wide range of the rotation speeds of the rotors. Upon angular displacement of the half-casings, concurrently with a change (decrease) of the phase-setting angle, there takes place a change of the precession angle, which can be used to advantage. As the precession angle decreases, the volume of the working chamber decreases to some extent, whereas the volume of the cocked chamber increases, in which chamber, as the speed of rotation of the rotors grows, the amount of spent working medium which has no time to leave the chamber being cocked, increases. A decrease of the precession angle as the speed of rotation of the rotors increases, reduces the loads in the rotor unit, deriving from the dynamics and kinematics of the machine.

The above-cited features of the centering device make it possible to increase the machine efficiency within a wide range of the rotation speeds of the rotors, to lower loads in the rotor unit, whereby the machine performance is increased and the service life is prolonged.

In order to provide lubrication and cooling of the rotor unit, the sector rotors have a through duct 26 and 27, coaxial with the shaft or fanning out into two or more ducts in the ball sector. In the sector rotor 5 the ducts come out to the side surface of the axle of the non-split diametrical hinge, where they are interconnected by a duct 28 passing along the generating surface of the non-split axle of the sector rotor. From the side of the meniscus hinge, the sector rotor 6, the ducts come out through an opening in the side surface of the semi-axles 22 and 21, enter the semi-axle, and run toward the meniscus. In the meniscus, through radial ducts 29 and 30, the ducts pass from the openings and converge in the center of the central rotor, constituting a cavity 31. The cavity thus formed communicates with the duct 28 of the axle of the non-split diametrical hinge during the precession motion of the rotors 4 and 5 in relation to each other. An embodiment of the machine is possible, wherein both diametrical hinges have a meniscus structure. In this embodiment, in the central rotor having two meniscus hinges, the radial ducts from both meniscus hinges converge in the center, connecting the ducts of both sector rotors. The journals of the semi-axles of the meniscus hinge prevent emergence of oil from the openings in the meniscus. Oil is supplied to the meniscus hinge from the duct to the semi-axles through capillary openings 32.

In a machine that does not require cooling of the rotor unit, the through coaxial duct of the rotor 5 comes out to the non-split axle of the diametrical hinge into the cavity of the central rotor, wherefrom, along the radial ducts of the meniscus, it comes to the semi-axles of the meniscus hinge. In the sector rotor 6, the through duct may be absent, and the section of the supply duct 28 may be reduced.

The kinematically linked rotors 5, 4, 6 of the machine constitute a rotor unit in the form of the Hooke joint Via the ducts of the rotor unit oil is pumped under pressure. The main bulk of the oil, after cooling the rotors, is diverted into the heat-exchanger of the machine. Under the effect of pressure and centrifugal overloads, the oil that provides lubrication of the diametrical hinges is transferred toward the periphery, where it accumulates in the gap between the disc rotor and the chamber-forming surface of the machine casing. The use of lubrication and cooling of the rotor unit makes for a higher performance and longer service life of the machine.

To remove oil from the periphery of the disc rotor, the machine casing is provided with an oil-scraper slot-type drainage system positioned in the jointing plane of the half-casings 1 and 2 between the centering device and the inner surface of the chamber-forming sphere. The system occupies a sector in the zone of complete overlapping of the chamber-forming spherical cavity by the central rotor during its precession motion. This sector will be hereafter referred to as "shadow sector". The shadow sector is disposed symmetrically to the 180th meridian, its area depends on the diameter of the axles of the diametrical hinges and on the precession of the machine. The system comprises a slot on the chamber-forming spherical surface between the edges of the half-casings, which forms a sector duct 33. The duct thus formed has one or more radial drain ducts 34.

The oil-scraper system, in the general case, may be constituted by a plurality of slots or by a system of openings arranged in the shadow sector, the slots (openings) being intercommunicated by one or several radial drainage ducts.

The oil gathered by the slot-type system and the work-ing medium that has penetrated through gaps are accumulated in said duct and then diverted along the drainage ducts to the receptacle of the machine lubrication and cooling system.

The use of the oil-scraper slot-type drainage system makes it possible to reduce oil losses in the machine.

To ensure assembleability of the machine, a gap is provided between the shaft section bordering on the ball sector of the sector rotor and the opening in the half-casing coming out to the spherical chamber-forming surface of the half-casing. The gap provides for a tilt of the shaft of the sector rotor during the mounting of the rotors 4, 5, 6 of the rotor unit in the half-casing of the machine. After jointing the machine casing, the gap may be used to accommodate a packing device 35 or an element of the bearing unit.

The positive-displacement sphere-shaped rotor machine operates in the following manner.

All the rotors in the machine perform only rotary motion, the central rotor 4 rotating only with respect to a point found in the center of intersection of the axles of the sector rotors 5, 6 and of the axles of the diametrical hinges.

Precession displacements of the sector rotors 5 and 6 with respect to the central rotor 4 ensure harmonic variation of the volume of the working chambers 9, 10, 11, 12, said volume originating as the rotor unit rotates. Thus, the machine of the invention is a structurally and kinematically symmetrical machine.

The chambers 3 and 10, adjacent to the sector rotor 5, communicate with the inlet duct 16 and the outlet duct 15, disposed on the semi-casing 1, and constitute an expansion loop "A". The chambers 11 and 12, adjacent to the sector rotor 6, communicate with the inlet duct 17 and the outlet duct 18, disposed on the semi-casing, and constitute a loop "B".

The adjacent chambers 9 and 10 of the loop "A" and the chambers 11, 12 of the loop "B" perform one complete working (compression-expansion) cycle during one revolution of the rotor unit. Thus, all the four chambers 9, 10, 11, 12 of the machine perform a complete working cycle during one revolution of the rotor unit. The adjacent chambers have a working cycle opposite to each other, shifted through 180°. For instance, if the chamber 9 is cocked, then the chamber 10 is expanded and has a maximum volume.

Kinematically, the working cycles of the chambers in the loops "A" and "B" are shifted through 90° with respect to each other.

For making the description of machine operation convenient, let us consider a machine, in which both diametrical hinges of the rotors 5 and 6 have a meniscus structure with the same diameter of the menisci 25. In such machine both expansion loops "A" and "B" are the same.

We shall use the two-loop symmetry of the machine to advantage, by describing the processes occurring in the loop "A". The processes occurring in the loop "B" fully repeat the processes in the loop "A" and are shifted through 90°.

Let us consider the case of switching on the proposed invention in the mode of an expansion machine, and more particularly in the mode of a steam engine.

Hot steam, which is a working medium, is supplied under pressure to the inlet ducts 16 and 17. The sector rotor 5 of the expansion loop "A" (FIG. 3) is in the position of the changeover of the working cycles in the adjacent chambers, the chamber 10 being cocked and the chamber 9 being expanded. As the rotor unit turns further (FIG. 1), the chamber 9 with the spent working medium is brought into communication with the outlet duct 15. The working medium flows out of the chamber 9 into the outlet duct 15 with a simultaneous reduction of the volume of the chamber 9. At the same time, the cocked chamber 10 is brought into communication with the duct 16. As a result, there takes place pressurization of the chamber 10 and its expansion under the effect of the working medium. The pressure exerted by the working medium on the chamber-forming surface of the central rotor 4 through the diametrical hinge of the central rotor 4 is received by the sector rotor 6, on which there originates a torque.

At the end of the working cycle in the chamber 10, i.e., 180° after the commencement of the process being described, the inlet duct 16 becomes overlapped by the sector rotor 5, and simultaneously the outlet duct 15 in the chamber 9 becomes overlapped. Since that moment, the chambers 9 and 10, operating in opposition to each other with the shift through 180°, exchange the places, and the working cycle is repeated.

The predominantly tangential tilt of the inlet duct 16 (FIG. 3) orients the flow of the working medium in the direction of rotation of the rotor. In this case the semi-axles 21 and 22 of the meniscus hinges do not experience a direct erosive effect from the jet of hot working medium entering the expansion chamber. The nozzle portions of the inlet-outlet ducts 15, 16, 17, 18 make it possible to increase the section of the inlet ducts and to reduce their hydrodynamic resistance.

For cooling the rotor unit of the rotors 4, 5, 6 and for lubricating the axles of the diametrical hinges of the machine, a lubricating cooling liquid (further referred to as liquid) is supplied under pressure to the duct 27 of the sector rotor 6. Along the duct 27 fanning out within the section of the sector rotor, the liquid comes to the radial duct of the semi-axles 21 and 22, wherealong it gets into the central rotor 4, and further via the ducts of the sector rotor 5 the liquid is discharged from the machine. The journals of the semi-axles 21 and 22, disposed in the openings of the meniscus 25, preclude leaking out of the liquid into the expansion chambers. Through the capillary openings 32 the liquid is brought to gaps between the rubbing surfaces of the meniscus hinge of the sector rotor 6. Under the effect of centrifugal overloads, the liquid moves along the semi-axles of the meniscus hinge to the periphery of the central rotor 4, where the liquid accumulates in the gap between the chamber-forming cavity of the semi-casings 1 and 2 and the central rotor 4.

From the gap the liquid is gathered by the slot-type drainage system, getting into the slot 33, and is discharged from the machine via the radial drainage duct 34. The semi-casings 1 and 2 of the machine, connected in the equatorial plane, ensure the symmetry and balanced life of the machine structure under the conditions of thermal and power loads, and also raise the level of unification of the machine, since the semi-casings 1 and 2 may be made interchangeable.

In the case of embodying the machine with two similar meniscus hinges in the rotor unit, the level of the machine unification becomes higher, since the sector rotors 5 and 6 may be made interchangeable.

The use of the centering device 3 which interconnects the semi-casings 1 and 2 with the possibility of their angular displacement (turning) makes it possible to vary the phase-setting angle and the angle of precession, which feature may be used for controlling the working cycle and the performance of the machine.

The machine of the invention is a reverse-type machine, since, if the working-medium is supplied to the ducts 15 and 18 and discharged from ducts 16 and 17, the direction of rotation of the rotor will be reversed.

Industrial Applicability

The machine of the present invention may be used as a compressor, a supercharger, a pump, a distributing machine, a metering device.

The machine of the invention is a two-loop machine, so that it may be incorporated into combination apparatus, such as chemical reactors, resuscitation and heart-lung apparatus, two-component mixers, etc.

The machine of the invention has a linear or almost linear dependence of its performance on the speed of rotation of the rotors; this simplifies the checking and control of the consumption of the working medium, e.g., in turbosupercharger propulsion units.

I claim:

1. A positive-displacement sphere-shaped rotor machine comprising:

a casing formed of two interconnected semi-casings forming a spherical cavity, a rotor unit, disposed in the spherical cavity, including a central rotor and two sector rotors defining four working chambers, each of the sector rotors being in the form of a sphere sector, the central rotor being hingeably interlocked at each side by a diametrical hinge to a corresponding one of the sector rotors, the sector rotors having chamber-forming radial surfaces formed by at least two of one of planes, curvilinear surfaces, and plano-curvilinear surfaces, the central rotor having a chamber-forming surface complementing the form of the chamber-forming radial surfaces of the sector rotors corresponding thereto, and inlet and outlet ducts for said four chambers each having a nozzle portion having a variable section, wherein:

an axis of each of the inlet ducts has a tangential tilt which is predominantly coincident with a rotational direction of the sector rotors and oriented to direct incoming jets of working medium not at said diametrical hinge, and an axis of each of outlet ducts has a tilt predominantly opposite to the rotational direction of the rotors.

2. A positive-displacement sphere-shaped rotor machine comprising:

a casing formed of two interconnected semi-casings forming a spherical cavity, a rotor unit, disposed in the spherical cavity, including a central rotor and two sector rotors defining four working chambers, each of the sector rotors being in the form of a sphere sector, the central rotor being hingeably interlocked a each side by a diametrical hinge to a corresponding one of the sector rotors, the sector rotors having chamber-forming radial surfaces formed by at least two of one of planes, curvilinear surfaces, and piano-curvilinear surfaces, the central rotor having a chamber-forming surface complementing the form of the chamber-forming radial surfaces of the sector rotors corresponding thereto, inlet and outlet ducts for said four chambers each having a nozzle portion having a variable section, an axis of each of the inlet ducts having a tangential tilt which is predominantly coincident with a rotational direction of the sector rotors and oriented to direct incoming jets of working medium not at said diametrical hinge, an axis of each of outlet ducts having a tilt predominantly opposite to the rotational direction of the rotors, and the diametrical hinge connected to one of the sector rotors being provided with two semi-axles mounted on projections of said one sector rotor and secured thereon, from a side facing the center of the spherical cavity, the semi-axles being provided with journals, the journals being located in openings made in a spherical meniscus projection, the meniscus being coaxial with the spherical cavity and constituting an extension of the central rotor, and said one sector rotor being provided with a spherical cavity which repeats the shape of the meniscus, the other sector rotor having a diametrical hinge with one non-split cylindrical axle.

3. A machine according to claim 2, wherein the semi-casings are interconnected in an equatorial plane equidistant from poles of the machine in each meridian section.

4. A machine according to claim 2, wherein the semi-casings are fastened together by means of a device which permits angular displacement of the semi-casings with respect to each other and to the zero meridian.

5. A machine according to claim 4, wherein each of the sector rotors is provided with a through duct coaxial to the shaft or fanning out into two or more ducts in the sphere sector, said ducts coming out to the surface of the axle of the non-split diametrical hinge, and where they are interconnected by a duct passing along the generating surface of the non-split axle, and from the side of the meniscus hinge the ducts come out through an opening in a side surface of the semi-axles, enter the semi-axle, and run toward the meniscus, where, through radial ducts from openings in the meniscus they converge in the center of the central rotor, and communicate with the duct of the axle of the non-split diametrical hinge during precession motion of the rotors in relation to each other or in the central rotor having two meniscus hinges the radial ducts of the meniscus hinges converge in the center, connecting the ducts of both sector rotors.

6. A machine according to claim 5, wherein the casing has an oil-scraper drainage slot or of a plurality of such slots, or a plurality of openings disposed on the spherical cavity in an equatorial sector of a zone of complete overlapping of the spherical cavity by the central rotor during its precession motion and connected by one or several outlet ducts.

7. A machine according to claim 6, wherein between portions of the shaft bordering with the sphere sector of the sector rotor and the opening in the semi-casing, coming out to the spherical surface of the semi-casing, a gap is provided, said gap ensuring a tilt of a shaft of the sector rotor when mounting the rotor unit into the machine casing, after joining the semi-casings, the gap being adapted to accommodate a packing device or an element of the bearing unit.

* * * * *